US006950616B2

(12) United States Patent
Saito et al.

(10) Patent No.: US 6,950,616 B2
(45) Date of Patent: Sep. 27, 2005

(54) FIXING APPARATUS AND IMAGE FORMING APPARATUS

(75) Inventors: Toru Saito, Shizuoka (JP); Atsutoshi Ando, Kanagawa (JP); Takehiko Suzuki, Shizuoka (JP); Tomoo Akizuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/671,702

(22) Filed: Sep. 29, 2003

(65) Prior Publication Data

US 2004/0197112 A1 Oct. 7, 2004

(30) Foreign Application Priority Data

Oct. 1, 2002 (JP) ..... 2002-288478

(51) Int. Cl.[7] ..... G03G 15/20
(52) U.S. Cl. ..... 399/69; 219/216; 399/329
(58) Field of Search ..... 399/69, 67, 328, 399/329, 330, 333; 219/216, 619, 469, 494

(56) References Cited

U.S. PATENT DOCUMENTS

| | | | | |
|---|---|---|---|---|
| 5,420,679 A | | 5/1995 | Goto et al. | 399/335 |
| 5,493,380 A | | 2/1996 | Saitou et al. | 399/328 |
| 5,543,904 A | | 8/1996 | Kato et al. | 399/335 |
| 5,745,833 A | | 4/1998 | Abe et al. | 399/330 |
| 6,049,691 A | | 4/2000 | Abe et al. | 399/330 |
| 6,088,567 A | | 7/2000 | Miyashiro et al. | 399/400 |
| 6,118,955 A | * | 9/2000 | Yoneda et al. | 399/69 |
| 6,383,628 B2 | | 5/2002 | Abe et al. | 428/334 |
| 6,438,349 B2 | | 8/2002 | Ando | 399/333 |
| 6,556,806 B2 | | 4/2003 | Tsuruya et al. | 399/322 |
| 2002/0017519 A1 | * | 2/2002 | Takagi et al. | 219/619 |
| 2003/0002882 A1 | * | 1/2003 | Takagi et al. | 399/69 |
| 2003/0049060 A1 | | 3/2003 | Suzuki | 399/361 |
| 2003/0049063 A1 | | 3/2003 | Suzuki et al. | 399/407 |
| 2003/0099478 A1 | * | 5/2003 | Okano | 399/69 |
| 2004/0033084 A1 | * | 2/2004 | Akizuki et al. | 399/69 |

FOREIGN PATENT DOCUMENTS

| | | | |
|---|---|---|---|
| JP | 3051085 B2 | | 3/2000 |
| JP | 2001-117412 A | * | 4/2001 |

* cited by examiner

*Primary Examiner*—Sophia S. Chen
(74) *Attorney, Agent, or Firm*—Fitzpatrick, Cella, Harper & Scinto

(57) ABSTRACT

A fixing apparatus in which at least one temperature detecting element for detecting a temperature of a fixing film and at least one temperature detecting element for detecting a temperature of a heat generating element are included, and which controls the heat generating element on the basis of the temperature of the fixing film detected by the temperature detecting element and thus achieves temperature controlling of the fixing film, and an image forming apparatus to which the fixing apparatus is applied are disclosed.

20 Claims, 9 Drawing Sheets

FIXING APPARATUS AND IMAGE FORMING APPARATUS

BACKGROUND OF THE INVENTION

1. Field of the Invention

The present invention relates to a fixing apparatus in which a fixing film having an elastic layer and a heat generating means provided so as to affect a non-fixing surface of the fixing film are included, and an image forming apparatus such as a copying machine, a laser beam printer (hereinafter, called LBP), a printer, a facsimile machine, a microfilm reader printer, a recorder or the like to which the fixing apparatus in question is applied.

More particularly, the present invention relates to a fixing apparatus of a method for (1) forming and bearing an unfixed toner image corresponding to target image information on the surface of a transfer material (paper, print paper, transfer material sheet, electrofax sheet, electrostatic recording sheet, OHP sheet, glossy paper, glossy film, or the like) in a direct transfer method or an indirect transfer method with user of toner made of a heat melting resin or the like by an image forming process means suitable for electrophotographic recording, electrostatic recording, magnetic recording or the like, and (2) performing a heat fixing process to heat and fix the unfixed toner image onto the surface of the transfer material as a permanent fixed image.

The present invention relates to a low-cost and short-risetime (i.e., short-warmup-time) color on-demand fixing apparatus which is used particularly in a color image forming apparatus.

2. Related Background Art

In recent years, colorization in image forming apparatuses such as a printer, a copying machine and the like advances. As a fixing apparatus which is used in such color image forming apparatuses, a heat roller fixing apparatus which has an elastic layer as the fixing member is well known. Here, FIG. 4 shows one example of the fixing apparatus which uses such a fixing roller having the elastic layer.

A fixing apparatus 101 is structured so that a transfer material P on which an unfixed toner image 105 has been borne can pass a contact nip portion 104 formed between two rollers consisting of a fixing roller 102 and a pressure roller 103 both temperature-adjusted.

When the unfixed toner image 105 passes the nip portion 104, this image is heated and pressed by the fixing roller (hereinafter, simply called roller) 102 and the pressure roller (hereinafter, simply called roller) 103, and thus obtained image is fixed as a finished image on the transfer material P.

Here, thermistors 106*a* and 106*b* are respectively in contact with the surfaces of the rollers 102 and 103, whereby the respective rollers 102 and 103 are temperature-adjusted based on the respective temperatures detected by the thermistors 106*a* and 106*b*.

Moreover, the rollers 102 and 103 respectively contain halogen heaters (hereinafter, simply called heaters) 107*a* and 107*b* at their centers, and radiant energy generated by the heaters 107*a* and 107*b* is respectively absorbed by aluminum core metals 108*a* and 108*b* provided inside the respective rollers 102 and 103, whereby the rollers 102 and 103 are heated resultingly.

Elastic layers 109*a* and 109*b* made of silicon rubber and each having the thickness of 2 mm are respectively provided around the aluminum core metals 108*a* and 108*b*, and coating layers 110*a* and 110*b* made of excellent separability and heat-resistance resin such as PFA (tetrafluoroethylene.perfluoroalkylether copolymer/tetrafluoroethylene. perfluoroalkylvinylether copolymer resin), PTFE (polytetrafluoroethylene/tetrafluoroethylene resin), FEP (tetrafluoroethylene.hexafluoropropylene copolymer/tetrafluoroethylene.hexafluoropropylene copolymer resin) or the like are respectively provided on the respective outward surfaces of the rollers 102 and 103 to prevent adhesion of toner, paper flour and the like.

In the nip portion 104, the elastic layer is provided on the side of the fixing roller being the fixing member with which the unfixed toner is in contact, because the surface of the toner image is made uniform as much as possible when this image is fixed. However, in the heat roller fixing apparatus having such an elastic layer as this, a heat capacity of the heat roller itself is large, whereby there is a problem that a time (warmup time) necessary to increase the temperature of the fixing roller 102 up to the temperature suitable for fixing the toner image is prolonged. Moreover, there is a problem that costs of the fixing member increase.

Incidentally, a fixing apparatus of film fixing method which is often used in a black-and-white printer or the like is well known as a short-warmup-time fixing apparatus. Here, FIG. 5 shows one example of the fixing apparatus like this.

In a fixing apparatus 201, a fixing film unit 202 which is structured to bring a heater 204 into contact with a transfer material P through a thin fixing film 203 around film guide 207 and thus perform heating is employed as a heating apparatus.

An endless film of heat-resisting resin having the thickness of, e.g., 50 $\mu$m or so is used as the fixing film 203, a separation layer (fluorocarbon resin coating layer or the like) having the thickness of 10 $\mu$m is formed on the surface of the endless film, and the heater 204 constitutes a resistance heat generating body on a ceramic substrate. A temperature detecting means 209 is in contact with the heater 204 to detect the temperature of the heater 204, whereby the temperature of the heater 204 is controlled by a not-shown control means to become a desired temperature. Besides, any elastic layer is not provided for the fixing film 203 so as to decrease the heat capacity of the fixing film 203.

Numeral 205 denotes a pressure roller which is disposed on the opposite side of the fixing film unit 202 through the transfer material P, thereby constituting a nip portion 206. Thus, an unfixed toner image 105 is fixed as a finished fixed image on the transfer material P by heat and pressure when the transfer material P passes the nip portion 206.

In the fixing apparatus 201 of such a structure, the heat capacity of the fixing film 203 is very small. Therefore, after turning on the power to the heater 204, it is possible to increase the temperature of the nip portion 206 up to a temperature enabling to fix the toner image in a short time.

However, when the fixing apparatus 201 which uses the fixing film 203 having no elastic layer is used as the fixing apparatus of a color image forming apparatus, the surface of the fixing film 203 cannot cope with the surface of the transfer material P, unevenness due to existence/inexistence of a toner layer, unevenness of the toner layer itself and the like. Consequently, a difference in heat applied from the fixing member occurs between the convex portion and the concave portion on the film.

That is, the heat from the fixing member is well transmitted to the convex portion which is sufficiently in contact with the fixing member, but it is hard to transmit the heat from the fixing member to the concave portion as compared with the convex portion. In a color image, because toner layers of plural colors are used and superposed to achieve color mixture, the unevenness on the toner layer is larger as compared with that in a black-and-white image. For this reason, when the fixing member does not include any elastic layer, uneven brightness on the image obtained after the image fixing was performed becomes noticeable, thereby degrading image quality. Also, in a case where an OHP sheet is used as the transfer material, image quality deteriorates due to poor permeability when the image obtained after the image fixing was performed is projected.

Moreover, when a silicon oil or the like is applied to the fixing member having no elastic layer so that the heat is well transferred entirely to the concave and convex portions of the transfer material and the unfixed toner image, a problem that costs increase occurs, and also a problem that the image obtained after the image fixing was performed and the transfer material are sticky with the oil occurs.

Consequently, the fixing apparatus which constitutes a low-cost color on-demand fixing apparatus by applying the fixing film having the elastic layer to the film fixing apparatus as shown in FIG. 5 is known (for example, see Japanese Patent No. 3051085).

However, such a conventional fixing apparatus includes the following problems.

1) The heat conductivity of the silicon rubber or the like used as the elastic layer of the fixing film is not so high, and a response is deteriorated because many members intervene between the surface of the fixing film and the temperature detecting means of the heater, whereby it is hard for the heater temperature detecting means to control the temperature on the surface of the fixing film. Particularly, it is hard for the heater temperature detecting means to detect that the heat on the surface of the fixing film is absorbed by the transfer material P when it passes the fixing apparatus and thus the temperature on the surface of the fixing film decreases, and besides it takes too long to a response in the temperature detecting procedure.

2) In a case where it is intended that in order to control the driving of the heater and thus control the temperature, the temperature detecting means is shifted from the heater portion to the surface of the fixing film, the inside of the fixing film and the like to detect the temperature of the fixing film; it is impossible to detect the temperature of the heater itself.

Consequently, in a case where the heater is energized and the heat is generated in the state that the rotation of the fixing film has stopped due to some reason, the temperature of the heater excessively increases because a temperature rise gradient of the heater is remarkably higher than that at the position of the temperature detecting means of the fixing film, whereby various problems that the heater itself is cracked, a member for holding the heater is melted down, and the like occur.

3) In a case where it is intended that in order to control the driving of the heater and thus control the temperature, only the temperature of the fixing film is detected, particularly, in a case where it is necessary to rapidly increase the temperature of the fixing film, for example, in case of increasing the temperature of the film from a room temperature state to a fixing temperature, the temperature of the heater becomes high when the temperature of the fixing film is increased to a desired temperature, whereby the member for holding the heater and a grease for securing slidableness between the heater and the fixing film deteriorate. Thus, the problem that a torque of the fixing apparatus becomes large due to long-time use. That is, when the torque of the fixing apparatus is large, the fixing apparatus cannot transport a medium in sheet transportation, whereby the fixing film stops and thus a jam occurs.

SUMMARY OF THE INVENTION

The present invention has been completed in view of the above conventional problems, and an object thereof is to provide a fixing apparatus which includes a fixing film having an elastic layer and a heat generating means disposed in the fixing film, and in which temperature control of the fixing film can be well performed and safety in an abnormal state is secured, and to provide an image forming apparatus which performs high-quality image forming by applying the fixing apparatus of the present invention.

To achieve the above object, the fixing apparatus according to the present invention comprises:

the fixing film having the elastic layer;

the heat generating means provided so as to affect a non-fixing surface of the fixing film;

at least one temperature detecting means for detecting the temperature of the fixing film;

at least one temperature detecting means for detecting the temperature of the heat generating means; and a controlling means for controlling the heat generating means on the basis of the detection temperature of the fixing film detected by the temperature detecting means.

More preferably, the heat generating means includes a ceramic substrate and a resistance heat generating body provided on the ceramic substrate.

Moreover, the image forming apparatus which is equipped with an image forming means for forming an unfixed image on an image transfer member to which an image should be transferred and a fixing device for fixing the unfixed image to the image transfer member, comprising:

the fixing film having the elastic layer;

the heat generating means provided so as to affect the non-fixing surface of the fixing film;

at least one temperature detecting means for detecting the temperature of the fixing film;

at least one temperature detecting means for detecting the temperature of the heat generating means; and a controlling means for controlling the heat generating means on the basis of the detection temperature of the fixing film detected by the temperature detecting means.

According to the present invention, in the fixing apparatus in which the heat generating means is provided in the fixing film having the elastic layer, at least one temperature detecting means for the fixing film and at least one temperature detecting means for the heat generating means are provided, and the temperature of the fixing film is controlled by controlling the heat generating means on the basis of the detection temperature of the fixing film detected by the temperature detecting means, whereby it is possible to responsively control the fixing film and also secure safety in an abnormal state.

Moreover, the controlling to the heat generating means based on the detection temperature of the heat generating means by the temperature detecting means and the controlling to the heat generating means based on the detection temperature of the fixing film by the temperature detecting means are combined only when printing starts, whereby it is possible to prevent that a temperature on the back side of a heater excessively increases in case of rapidly increasing the temperature of the fixing film, and prevent that parts are deteriorated and a torque of the fixing device increases in case of ordinary use, thereby enabling more stable use.

Moreover, in the image forming apparatus which is equipped with the image forming means for forming the unfixed image on the image transfer member and the fixing device for fixing the unfixed image to the image transfer member, the fixing apparatus of the present invention is applied as the fixing device, whereby it is possible to obtain the image forming apparatus which performs high-quality image forming.

DESCRIPTION OF THE PREFERRED EMBODIMENTS

Hereinafter the embodiments of the present invention will be explained.

(Embodiment 1)

Figure 1:
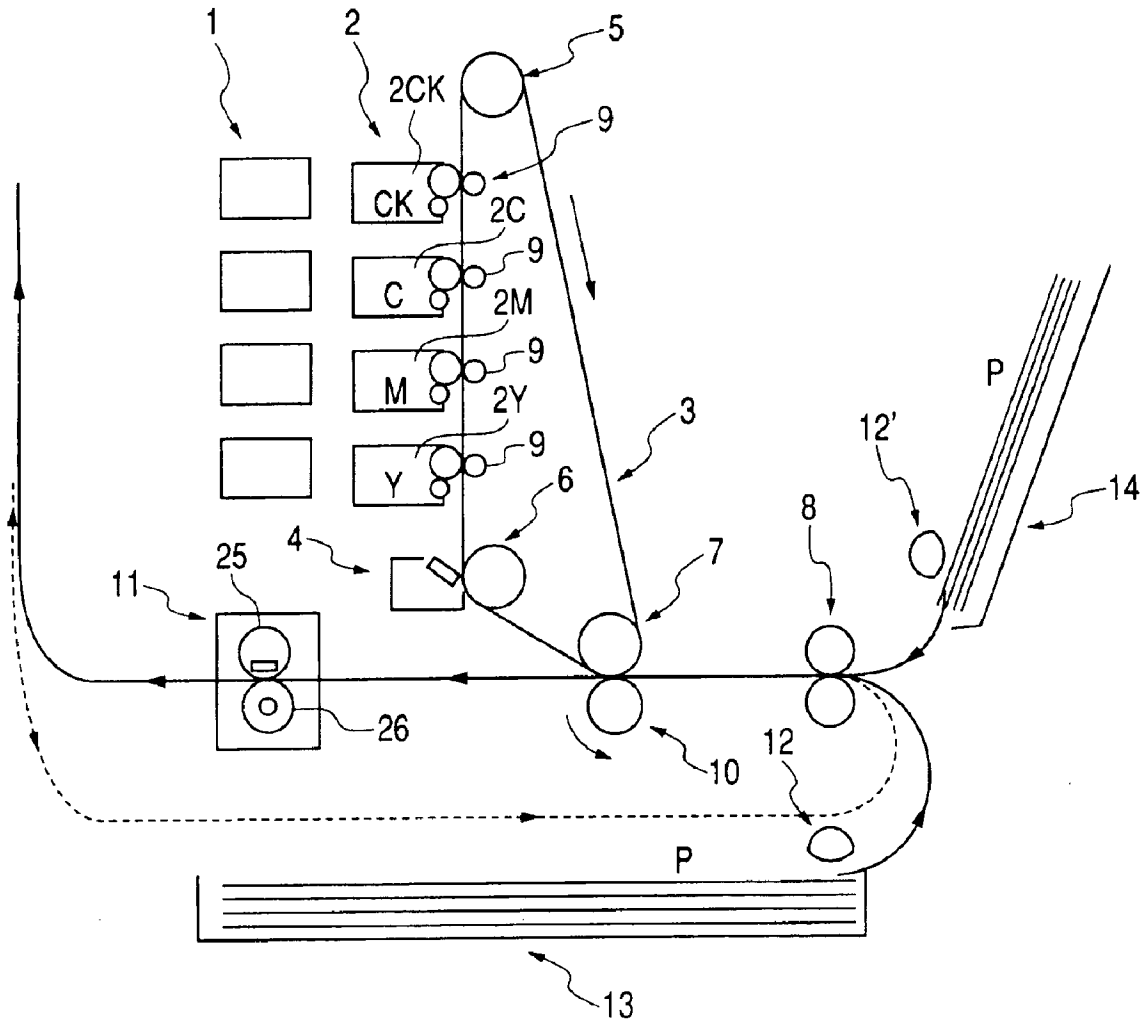
FIG. 1 is a schematic explanatory diagram showing one example of a color image forming apparatus in which a fixing apparatus of the present invention is used.

FIG. 1 is a schematic structural diagram showing a color image forming apparatus to which a fixing apparatus of the present invention is applied. In the present embodiment, an in-line color image forming apparatus of an intermediate transfer body system is used, and an automatic double-side mechanism (not shown) acting as a known automatic double-side transporting means is provided after the fixing apparatus, whereby a transfer material to which image fixing has been once performed can be automatically inverted and again transported for refeeding.

In FIG. 1, the portion indicated by the solid lines denotes a transporting path of the transfer material on which the image fixing to the first surface of the transfer material is performed in an automatic double-side image forming mode, and the portion indicated by the dotted lines denotes a reverse transporting path of the transfer material on which the image fixing to the second surface of the transfer material is performed by the automatic double-side mechanism.

Hereinafter, the structure of the color image forming apparatus according to the present embodiment will be explained.

In the present embodiment, a so-called all-in one CRG (i.e., type of cartridge) 2 in which a photosensitive drum (an OPC (organic photo conductor) drum is used), a charging (or electrifying) means (not shown), a toner developing unit (not shown), a cleaning means (a not-shown cleaning blade is used) for the photosensitive drum, and the like are collectively included in one container is used. More specifically, four CRG's of a yellow CRG 2Y using a yellow (Y) toner, a magenta CRG 2M using a magenta (M) toner, a cyan CRG 2C using a cyan (C) toner and a black CRG 2CK using a black (CK) toner are used.

Besides, four optical systems 1 corresponding to the CRG's of the four color toners are provided. Thus, a scan beam supplied from the optical system (a laser scan exposure optical system is used) based on image data is exposed on the photosensitive drum uniformly charged by the charging means (a charging roller is used), whereby an electrostatic latent image corresponding to the image data is formed on the surface of the photosensitive drum. Then, the toner (nonmagnetic one-component toner is used) acting as a developer is supplied onto the surface of the photosensitive drum on which the electrostatic latent image has been formed. Thus, by setting a developing bias applied to the developing roller to have an appropriate value between a charging potential and a latent image (exposed portion) potential, developing of selectively adhering the toner charged in negative polarity to the electrostatic latent image on the photosensitive drum is performed.

A single-color toner image developed on the photosensitive drum is primarily transferred to an intermediate transfer body 3 (an intermediate transfer belt is used) by a bias of positive polarity opposite to the polarity of the toner applied to a primary transfer roller 9. Here, it should be noted that the intermediate transfer body 3 is suspended and rotated around a driving roller 5, a tension roller 6 and a secondary transfer opposite roller 7 in synchronism with the photosensitive drum at substantially the same speed.

After the primary transfer ended, the toner which remains as transfer remainders on the photosensitive drum is eliminated by the cleaning means 4 (a not-shown cleaning blade is used).

The above process is performed sequentially to he CRG 2Y for yellow (Y), the CRG 2M for magenta (M), he CRG 2C for cyan (C) and the CRG 2CK for black (CK) in synchronism with the rotation of the intermediate transfer body 3, whereby the primary-transferred toner images of the respective colors are sequentially formed and superposed on the intermediate transfer body 3. On one hand, when an image of only single color is formed (in a single-color mode), the above process is performed only to the developing unit of the target color (e.g., black).

Incidentally, transfer materials P which are set on a transfer material cassette 13 or a transfer material tray (MP tray) 14 acting as a transfer material supplying unit are selectively fed by a feed roller 12 or 12', and the fed transfer material P is then transported at predetermined timing to a nip portion acting as a secondary transfer unit between the intermediate transfer body 3 and a secondary transfer means 10 by a pair of registration rollers 8.

The primary-transferred toner images formed on the intermediate transfer body 3 are transferred in a lump on the transfer material P by a bias of positive polarity opposite to the polarity of the toner applied to a secondary transfer means 10 (a secondary transfer roller is used in the present embodiment). After the secondary transfer ended, the toner which remains as secondary transfer remainders on the intermediate transfer body is eliminated by the cleaning means 4 (the cleaning blade is used in the present embodiment).

As the intermediate transfer belt used as the intermediate transfer body 3, a resin film belt such as PVdF (polyvinylidene fluoride), polyamide, polyimide, PET (polyethylene terephthalate), polycarbonate or the like having the thickness of 50 $\mu$m to 200 $\mu$m and the volume resistivity of $10^8$ Ωcm to $10^{16}$ Ωcm or so, a rubber belt in which an excellent-separability and high-resistance resin layer having the thickness of several tens of micrometers is provided on a low-resistance rubber base layer having the thickness of 0.5 mm to 2 mm or so, and the like can be used. In the present embodiment, a polyimide belt having the thickness of 50 $\mu$m to 75 $\mu$m is used because it is highly durable and can be cleaned up by the cleaning blade.

The toner image secondarily transferred to the transfer material P is melted and fixed to the transfer material P when it passes a fixing apparatus 11 acting as a fixing means, whereby the fixed image is obtained as an output image of the image forming apparatus.

Figure 2:
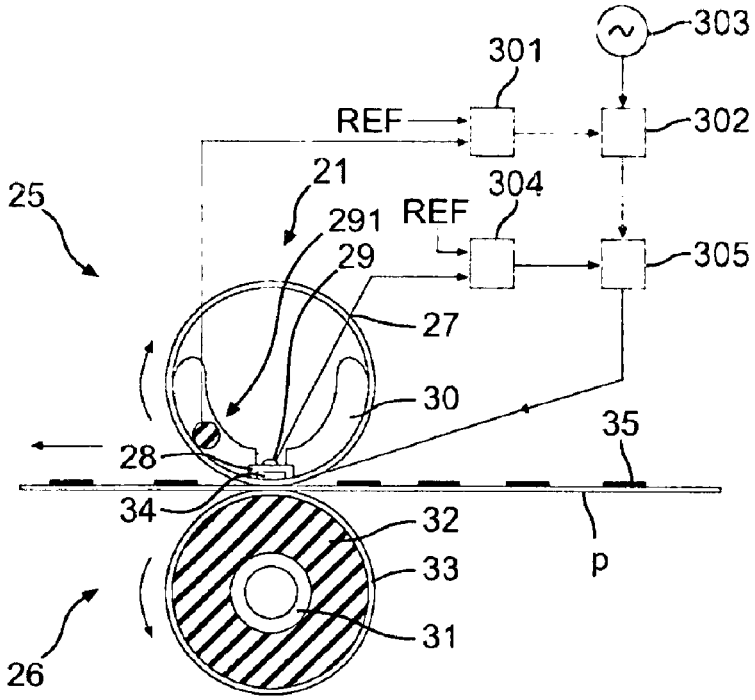
FIG. 2 is a schematic structural diagram showing the fixing apparatus according to the embodiment 1 of the present invention.

FIG. 2 is a schematic structural diagram showing the fixing apparatus according to the embodiment 1 of the present invention, which is applied to the color image forming apparatus shown in FIG. 1. In FIG. 2, a fixing film unit 25 acting as a fixing member consists of a base layer 27 of cylindrical endless film of a heat-resisting resin (a polyimide resin is used in the present embodiment) having the length of about 230 mm, the thickness of 50 $\mu$m and the outer diameter Φ of 24 mm, an elastic layer having the thickness of about 200 $\mu$m (a silicon rubber having the heat conductivity of about $1.0\times10^{-3}$ cal/sec cm° C. is used in the present embodiment) provided on the base layer 27, and a fluorocarbon resin tube having the thickness of about 30 $\mu$m covering the fixing film unit 25 as a separation surface layer 21.

Incidentally, another heat-resisting resin or a metallic layer may be used as the base layer of the fixing film. A ceramic heater (a heater in which a resistance heat generating body 34 is provided on a ceramic substrate 28 such as alumina, aluminum nitride or the like and then a glass coat is provided thereon is used in the present embodiment) acting as a heat generating means is included in the fixing film.

A thermistor 29 acting as a temperature detecting means of the heat generating means is in contact with the surface of the ceramic heater which is not in contact with the fixing film, whereby the temperature of the heat generating means is detected by the thermistor 29.

Besides, a thermistor 291 acting as the temperature detecting means for the fixing film is provided so as to be in contact with the inner surface of the fixing film in the vicinity of the outlet of the fixing nip portion, whereby the temperature of the fixing film is detected by the thermistor 291, and electrification (i.e., supply of power) to the heat generating means is controlled based on the detected result so that the temperature of the fixing film becomes a desired temperature. Thus, a temperature control operation to the fixing film is performed as a whole. Moreover, the temperature of the heat generating means itself is detected by the thermistor 29, and a necessary operation to the heat generating means is performed based on the detected temperature, for example, electrification to the heat generating means is urgently stopped when the temperature of the heat generating means excessively increases.

For example, the detected value of the thermistor 291 is compared with a reference value by a comparing circuit 301, and an electrification amount control means 302 is controlled based on the output value of the comparing circuit 301. Thus, phase controlling of the AC power to be supplied from an AC power supply 303 to the resistance heat generating body 34 acting as the heat generating means is performed, whereby the temperature of the fixing film is properly maintained. On one hand, the detected value of the thermistor 29 is compared with a reference value by a comparing circuit 304, and a switching circuit 305 is turned off based on the output of the comparing circuit 304 to urgently stop electrification to the resistance heat generating body 34 when the temperature of the fixing film excessively increases due to some reason.

The fixing film is rotatably supported by a film guide 30, and the ceramic heater integrally provided on the film guide 30 is pressed toward a pressurizing member (a pressurizing roller 26 is used) by a not-shown pressurizing mechanism with a total pressure of about 196 N (about 20 kgf) in the present embodiment, whereby the fixing film rotatably supported by the film guide 30 is in pressure-contact with the pressurizing roller 26.

Moreover, a grease for securing slidableness is applied on the surface where the ceramic heater slides across the fixing film.

In the pressurizing roller 26, a silicon rubber elastic layer 32 having the thickness of 3.5 mm, and fluorocarbon resin tube layer such as PFA (tetrafluoroethylene.perfluoroalkylether copolymer), EP (tetrafluoroethylene.hexafluoropropylene copolymer/tetrafluoroethylene.hexafluoropropylene copolymer resin) or the like having the thickness of 40 $\mu$m and acting as a molding surface layer 33 are sequentially formed on an iron core 31 having the outer diameter Φ of 13 mm.

The outer diameter Φ of the pressurizing roller 26 is about 20 mm, the product hardness thereof is about 60 degrees (the hardness value measured by the hardness tester ASKER-C (™) of KOBUNSHI KEIKI CO., LTD. in a total load of about 9.8 N (about 1 kgf)), and the width of the fixing nip is about 5.5 mm to 6.5 mm.

In the present embodiment, the pressurizing roller 26 is rotatively driven by a not-shown driving means, and the fixing film of the fixing film unit 25 is rotated according to the rotation of the pressurizing roller 26.

Besides, substantially spherical toner (hereinafter simply called polymerized toner) which has been manufactured in a polymerization method, includes a low softening point material of 5% to 30% by weight, and has a shape factor SF-1 of 100 to 110 is used as the toner in the present embodiment.

Moreover, the low softening point material is the chemical compound in which the main body maximum peak value measured in conformity with ASTMD3418-8 indicates 40° C. to 90° C. Here, the temperature at the maximum peak value of the polymerized toner is measured by, e.g., DSC-7 manufactured by PerkinElmer, Inc., the temperature of the device detecting unit is corrected by using the melting point of In (indium) and Zn (zinc), and the calorific value is corrected by using heat of melting of In.

A vacant pan for comparison is set by using an aluminum pan, and a sample is measured in a temperature increase speed of 10° C./min. More specifically, paraffin wax, polyolefin, Fischer-Tropsch (™) wax, amide wax, higher fatty acid, ester wax, and derivatives of them, or graft/block compound of them can be used. Preferably, the ester wax having one or more long-chain ester portion of which the carbon number represented by the following general constitutional formula is 10 or more is used. Here, the constitutional formulae of the representative compounds of the concrete ester wax will be shown as the general constitutional formulae (1), (2) and (3).

General Constitutional Formula (1) of Ester Wax $$[R1—COO—(CH_2)_n]_a—C—[(CH_2)_m—OCO—R2]_b$$

a, b: integer from 0 to 4, and a+b=4

R1, R2: organic group of which carbon number is integer from 0 to 40, and difference in carbon number between R1 and R2 is 10 or more n, m: integer from 0 to 15, and it is impossible that both n and m become 0 at the same time General Constitutional Formula (2) of Ester Wax $$[R1—COO—(CH_2)_n]_a—C—[(CH_2)_m—OH]_b$$

a, b: integer from 0 to 4, and a+b=4

R1: organic group of which carbon number is integer from 1 to 40 n, m: integer from 0 to 15, and it is impossible that both n and m become 0 at the same time General Constitutional Formula (3) of Ester Wax $$[R1—COO—(CH_2)_n]_a—C(—R3)—[(CH_2)_m—OCO—R2]_b$$

a, b: integer from 0 to 3, and a+b≦3

R1, R2: organic group of which carbon number is integer from 1 to 40, and difference in carbon number between R1 and R2 is 10 or more R3: organic group of which carbon number is 1 or more n, m: integer from 0 to 15, and it is impossible that both n and m become 0 at the same time The ester wax preferably used in the present invention has the hardness of 0.5 to 5.0. Here, it should be noted that the hardness of the ester wax is measured by first forming a cylindrical sample having the diameter of 20 mm and the thickness of 5 mm and then measuring Vickers hardness of the formed sample with a dynamic ultra micro hardness tester (DUH-200) manufactured by SHIMADZU CORPORATION. More specifically, the sample to be measured is first displaced by 10 μm under the condition of the load 0.5 g and the load speed 9.67 mm/sec, the displayed sample is held for 15 seconds, and then the obtained struck mark on the sample is measured, whereby obtaining the Vickers hardness. The hardness of the ester wax preferably used in the present invention has the value within the range of 0.5 to 5.0. Incidentally, examples of concrete chemical compounds will be shown by the following chemical formulae (1), (2), (3) and (4).

(1)

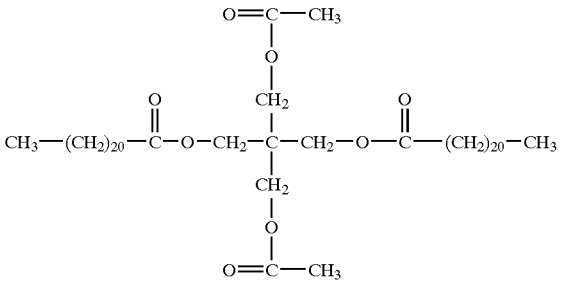

(2)

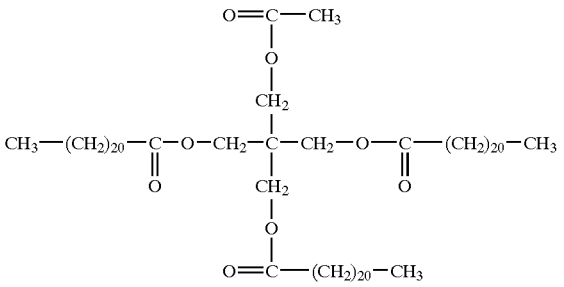

(3)

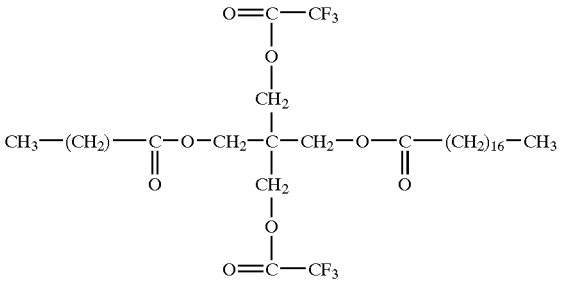

(4)

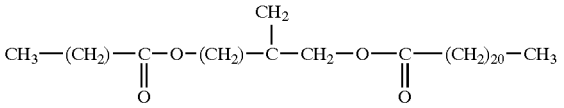

Incidentally, the shape factor SF-1 is the numeric value indicating a ratio of sphere in a spherical material. In other words, the square of the maximum length MAXLNG of the oval figure obtained by projecting the spherical material on a two-dimensional plane is divided by the figure area AREA, and the obtained value is multiplied by 100 π/4, thereby obtaining the shape factor SF-1. That is, the shape factor SF-1 is defined by the following equation.

$$[SF-1] = \frac{\pi \times \left(\frac{MAXLNG}{2}\right)^2}{\text{AREA}} \times 100 = \frac{(MAXLNG)^2}{\text{AREA}} \times \left(\frac{100\pi}{4}\right)$$

More specifically, 100 toner images are sampled at random by a scanning electron microscope FE-SEM (S-800) manufactured by Hitachi, Ltd, the image information of these samples is supplied to and analyzed by an image analyzing apparatus (Luzex3) manufactured by Nireco Corporation, and then the coefficient is calculated according to the above equation.

Incidentally, the cyan toner is adjusted as follows. That is, ion exchanged water of 710 part by weight and 0.1-mol/l $Na_3PO_4$ aqueous solution of 450 part by weight are added to a 2l four-outlet flask having a high-speed agitator, the number of rotations of the agitator is adjusted to 1,200 rotations, and the flask is heated up to 65° C. Then, 1.0-mol/l $CaCL_2$ aqueous solution of 68 part by weight is gradually added to the flask, thereby adjusting a dispersion medium system including a fine hardly aqueous soluble dispersing agent $Ca_3(PO_4)_2$. On one hand, a dispersoid system is given as follows:

| | |
|---|---|
| styrene monomer | 165 part by weight |
| n-butyl acrylate monomer | 35 part by weight |
| I. pigment blue 15:30 | 14 part by weight |
| saturated polyester [terephthalic acid-propylene oxide denatured bisphenol-A acid value 15, peak molecular weight: 6,000] | 10 part by weight |
| salicylic metallic compound | 2 part by weight |
| undermentioned compound (maximum peak value 59.4° C.) | 60 part by weight |

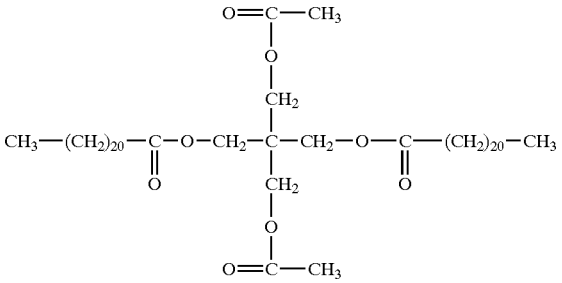

After the above mixture was dispersed for three hours by using an attritor, the dispersed mixture to which a polymerization initiator 2,2'-Azobis(2,4-dimethylvaleronitrile) of 10 part by weight has been added is put in the dispersion medium, and granulation is performed for 15 minutes as maintaining the number of rotations. After then, the agitator is changed from the high-speed agitator to a propeller agitator, the inner temperature is raised up to 80° C., and the polymerization is continued at 50 rotations for ten hours. After the polymerization ended, a chiller is cooled down, dilute hydrochloric acid is added, and the dispersion medium is eliminated. Moreover, by performing cleaning and drying, the cyan toner, measured by a Coulter(™) counter, of which the weight-average grain diameter is 6.2 μm, the coefficient of number variation is 27%, and the shape factor SF-1 is 104 obtained. Similarly, the yellow toner, the magenta toner and the black toner of which the shape factor SF-1 is 104 are manufactured.

Incidentally, C.I. pigment yellow 17 is used for the yellow toner, C.I. pigment red 122 is used for the magenta toner, and carbon black is used for the black toner.

In the fixing apparatus 11, the pressurizing roller 26 is rotatively driven at rotation speed of about 100 mm/sec, and the electrification to the ceramic heater is adjusted so that the temperature of the fixing nip portion becomes suitable for fixing the toner image (180° C. or so on the surface of the fixing film in the present embodiment).

After the secondary transfer process ended, the transfer material P on which an unfixed toner image 35 has been put on is introduced to the fixing nip portion, and the unfixed toner image 35 is melted by the pressure applied from the fixing nip portion and the heat transferred from the ceramic heater through the fixing film, whereby the melted toner image is fixed to the transfer material P as the fixed image.

In the fixing apparatus 11 according to the present embodiment, the elastic layer of the fixing film is made thin to the extent of about 200 μm, and the outer diameter Φ thereof is made small (about 24 mm), whereby the heat capacity of the fixing film is small. Therefore, when power of about 900 W is input as the heat generating means, the warmup time can be shortened to the extent of about 10 to 12 seconds, whereby so-called on-demand fixing can be achieved.

Next, temperature changes of the fixing film and the like in the case where the transfer material P passes in the fixing apparatus 11 according to the present embodiment will be explained.

Figure 5:
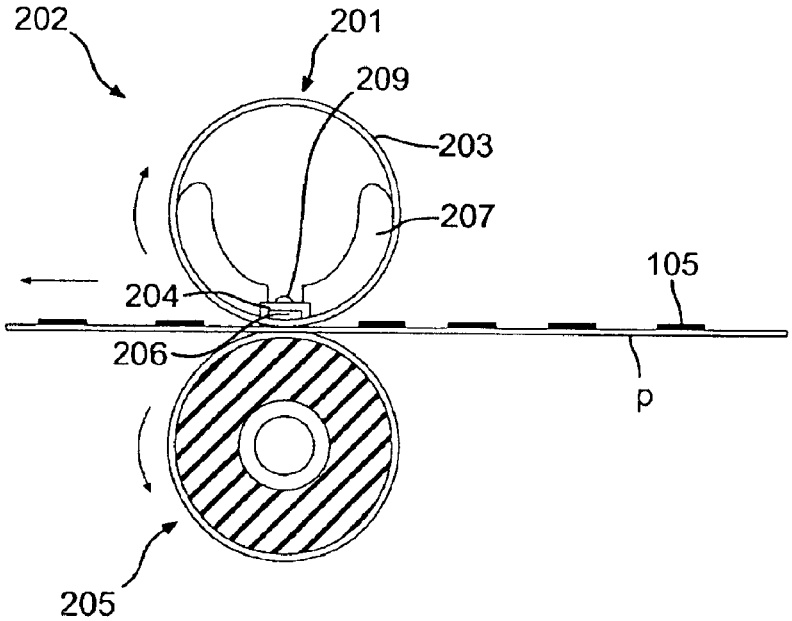
FIG. 5 PRIOR ART
FIG. 5 is a schematic structural diagram showing one example of the fixing apparatus which uses a fixing film having no elastic layer.
Figure 6:
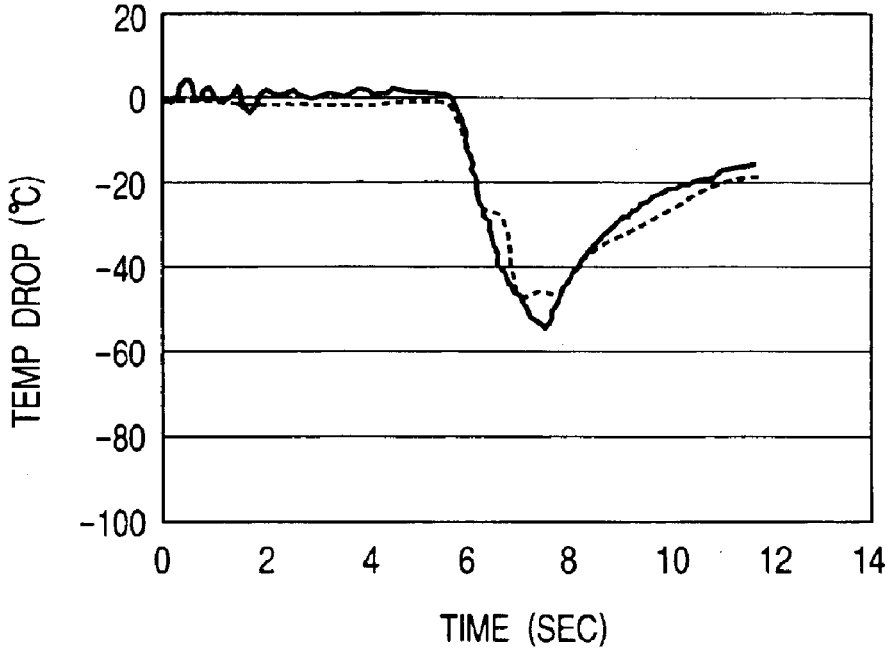
FIG. 6 is a graph for explaining temperature drop and the like of the fixing film.

A graph 1 in FIG. 6 is the graph showing the state in a case where the fixing film having no elastic layer is used as the fixing film 203 in the film fixing apparatus as shown in FIG. 5. In the graph 1, the solid line indicates the temperature of the fixing film 203, and the dotted line indicates the temperature of the heat generating body. In any case, the graph 1 shows the portion that the temperature changes when premium multipurpose 4024 paper (basic weight 105 g/m$^2$, letter size) manufactured by Xerox Co., Ltd. is fed. In this case, since the fixing film 203 has no elastic layer, a difference in temperature between the fixing film and the heat generating body is small.

Figure 7:
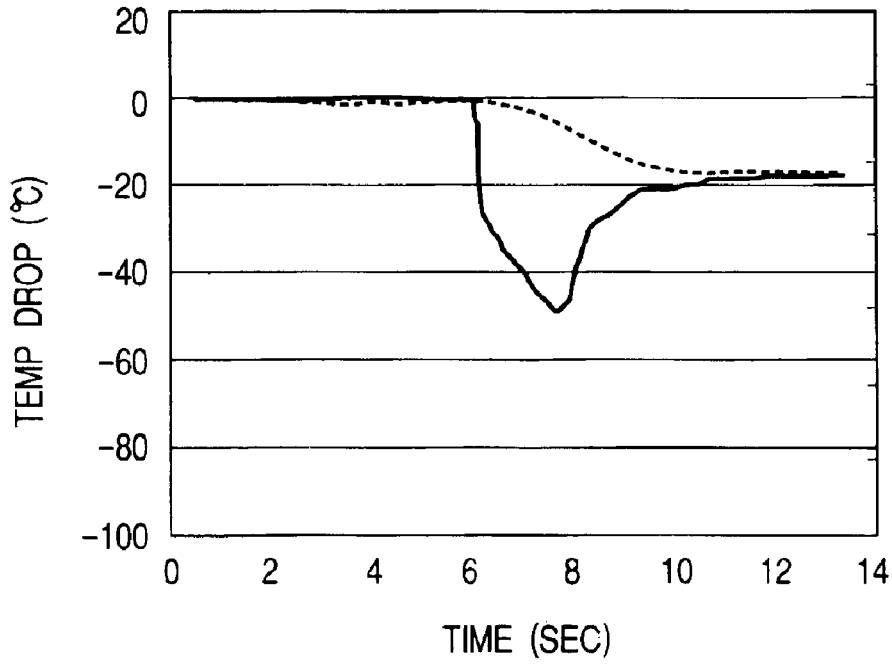
FIG. 7 is a graph for explaining the temperature drop and the like of the fixing film.

A graph 2 in FIG. 7 is the graph showing the state that the transfer material P passes when the film having the elastic layer is used as the fixing film 203 and the temperature control is performed by the temperature detecting means being in contact with the heating body, as in the related background art. In this case, since the fixing film 203 has the elastic layer, the heat of the fixing film 203 is absorbed by the transfer material P, and the temperature of the fixing film drops, whereby it takes time until the temperature of the fixing film becomes the temperature of the heating body.

Since the heat of the fixing film 203 is absorbed by the transfer material P until the temperature drop is detected by the temperature detecting means of the heat generating means, the temperature drop of the fixing film cannot be prevented. Therefore, the temperature drop of the fixing film 203 is large to the extent of about 20° C., whereby problems that a margin of fixability becomes small and a difference in glossiness appears occur.

Figure 8:
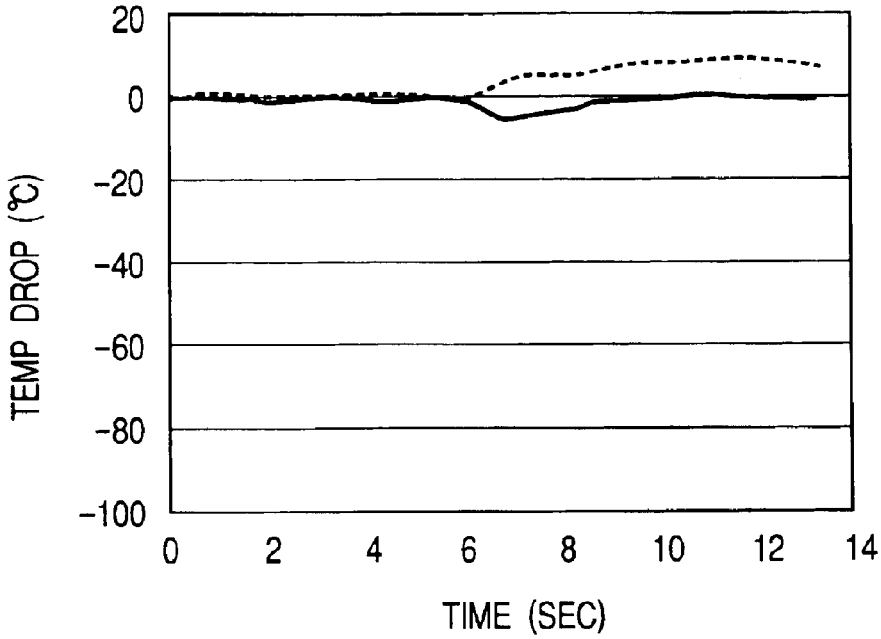
FIG. 8 is a graph for explaining the temperature drop and the like of the fixing film.

A graph 3 in FIG. 8 is the graph in the embodiment 1. In the state shown in the graph 3, the fixing film having the elastic layer is used as the fixing film, and the temperature control is performed by controlling the heat generating body based on the temperature detected by the temperature detecting means 291 being in contact with the inner surface of the fixing film. In this case, since the temperature drop of the fixing film in case where the transfer material P passes can be detected earlier than the case of the graph 2, the control of the heat generating body can be responsively performed without delay so much in regard to the temperature drop of the fixing film, whereby it is possible to decrease the temperature drop of the fixing film. In the present embodiment, the temperature drop can be suppressed within the limits of about 10° C.

Moreover, in the present embodiment, when the temperature of the heat generating body is detected by the temperature detecting means 291, the abnormal high temperature to be detected is set to about 250° C. or so. Here, it is assumed that the electrification to the heat generating body is performed with the fixing film unit 25 being stopped in the abnormal state. In this case, as well as the conventional case, even if it is intended to detect the abnormal high temperature based on the temperature detected by the temperature detecting means for temperature control (corresponding to the temperature detecting means of the fixing film in the present embodiment), the temperature of the heat generating body excessively increases, because the rotation of the fixing film has stopped and thus the temperature rise gradient of the fixing film is not large at the position of the temperature detecting means on the fixing film, whereby various problems that the heater is cracked, that the heater holder is melted down, and the like occur.

In the present embodiment, the temperature control is performed based on the temperature detected by the temperature detecting means of the fixing film, and more specifically, the abnormal high temperature of the heat generating body is detected based on the detected temperature by the temperature detecting means of the heat generating body. Therefore, even if the electrification to the heat generating body is performed in the state that the rotation of the fixing film stops, the abnormal high temperature can be detected by the temperature detecting means of the heating body before the temperature of the heating body excessively increases, it is possible to quickly take measures, for example, stopping the electrification to the heat generating body, whereby it is possible to secure safety.

Besides, although the in-line (tandem) color image forming apparatus is explained as the color image forming apparatus in the present embodiment, the same effects can be obtained in the color image forming apparatus which adopts another color image forming method.

(Embodiment 2)

Figure 3:
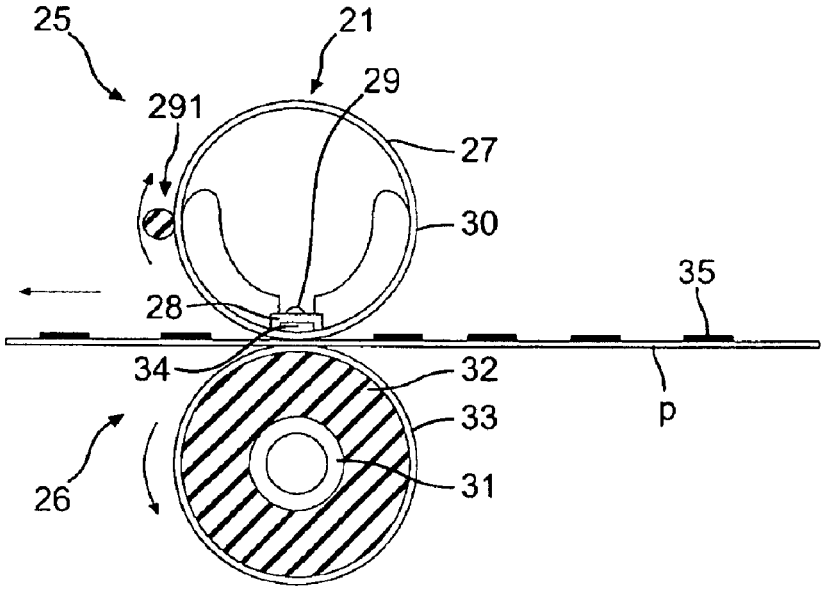
FIG. 3 is a schematic structural diagram showing the fixing apparatus according to the embodiment 2 of the present invention.
Figure 4:
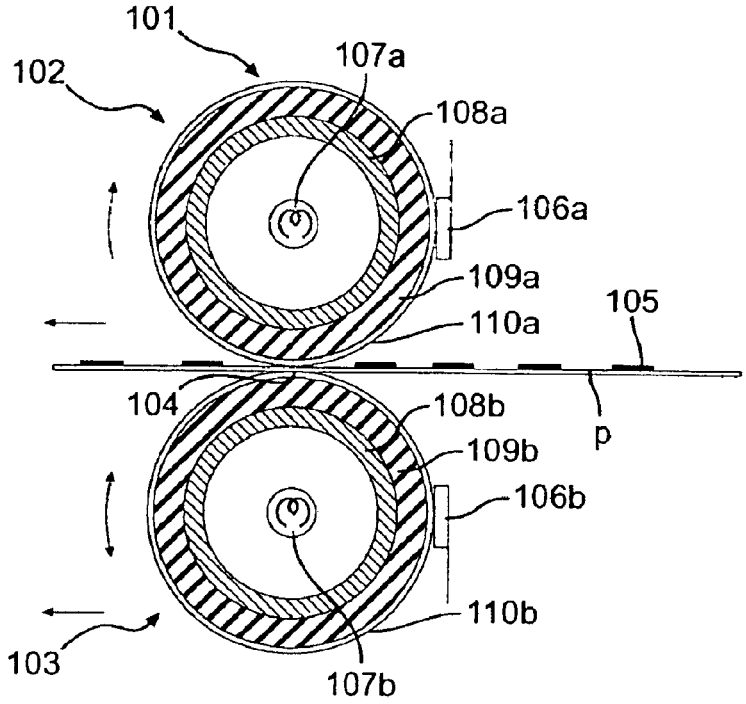
FIG. 4 PRIOR ART
FIG. 4 is a schematic structural diagram showing a conventional heat roller fixing apparatus being one example of the fixing apparatus which uses a fixing member having an elastic layer.

The embodiment 2 of the present invention will be explained hereinafter. FIG. 3 is a schematic structural diagram showing a fixing apparatus according to the embodiment 2 of the present invention. In FIG. 3, the explanation will be omitted in regard to the portions same as those in the embodiment 1. In the embodiment 2, unlike the embodiment 1, a temperature detecting means 291 of a fixing film is set to be in contact with the outer surface of the fixing film.

Figure 9:
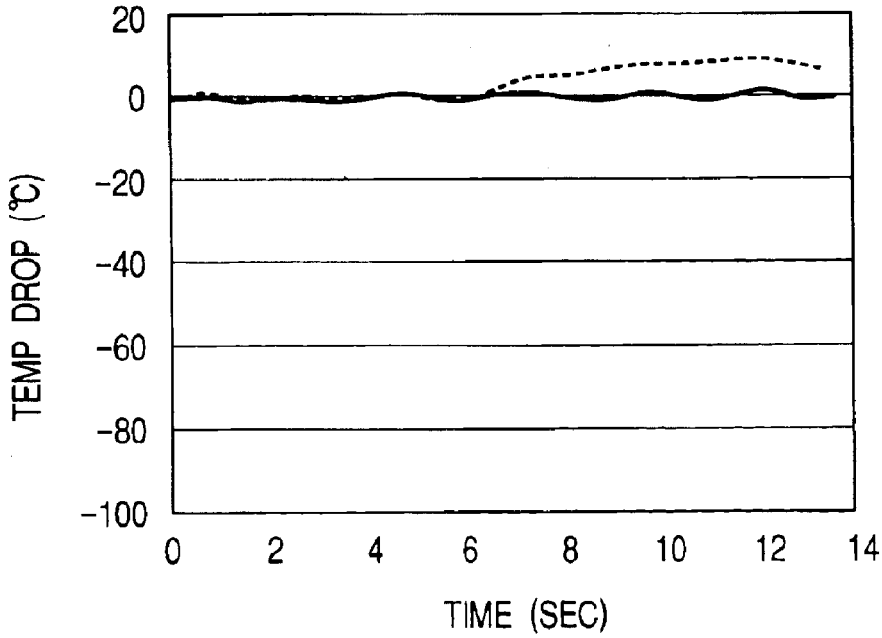
FIG. 9 is a graph for explaining the temperature drop and the like of the fixing film.

A graph 4 in FIG. 9 shows a temperature drop of the fixing film and the like according to the embodiment 2. In the present embodiment, because the temperature detecting means of the fixing film is set to be in contact with the surface of the fixing film, the temperature drop of the fixing film by a transfer material P can be responsively detected as compared with the embodiment 1, whereby the temperature drop of the fixing film can be suppressed within the limits of about 5° C.

(Embodiment 3)

The embodiment 3 of the present invention will be explained hereinafter. A fixing apparatus to be used in the present embodiment is the same as that used in the embodiment 1, whereby the explanation thereof will be omitted.

The present embodiment is different from the above embodiments in the point that the control of preventing the temperature of a ceramic heater from exceeding a certain temperature based on the temperature detected by a temperature detecting means being in contact with the ceramic heater is combined with ordinary temperature control only when printing starts, thereby preventing excessive temperature rise of the ceramic heater.

Figure 10:
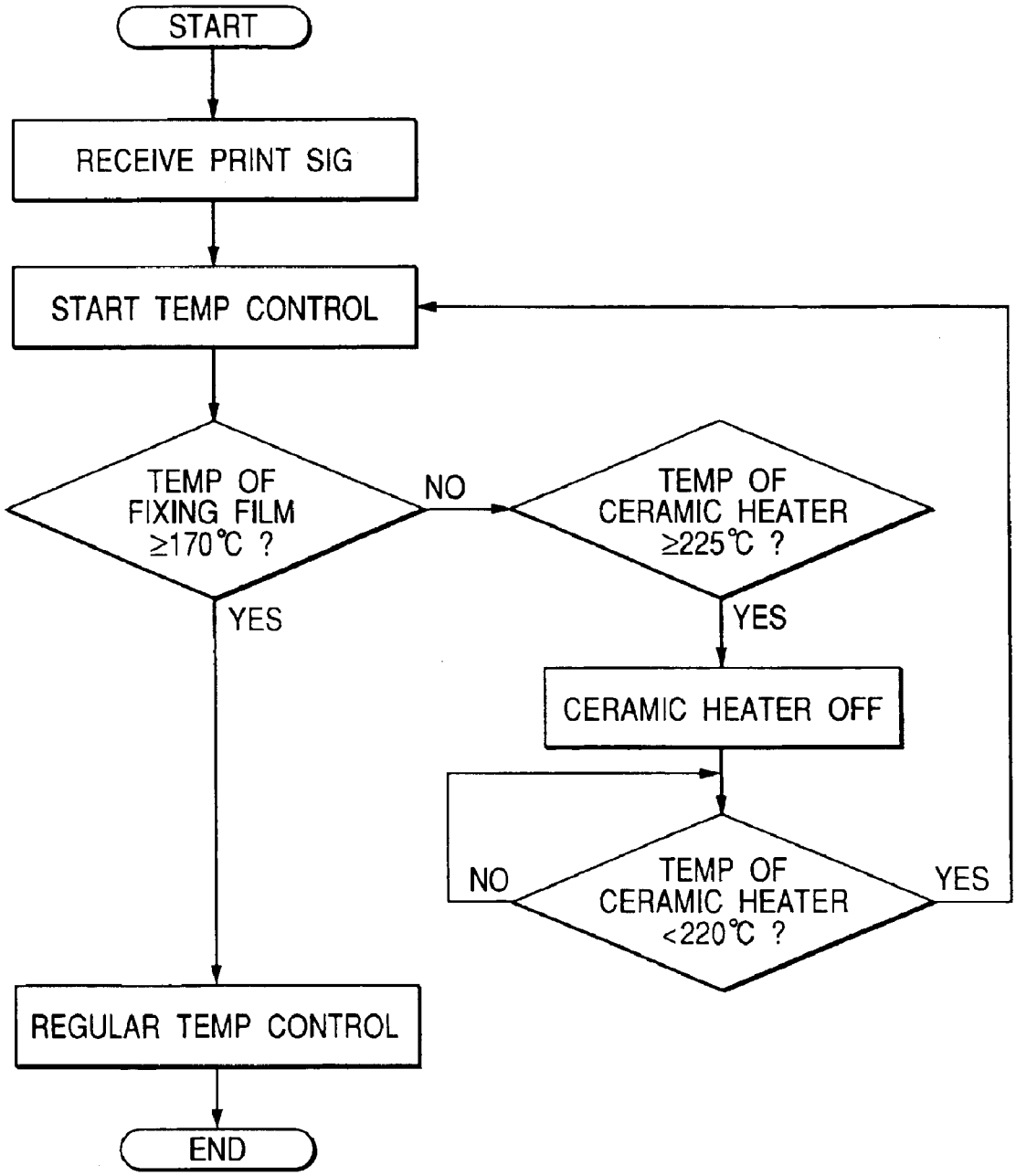
FIG. 10 is a flow chart for explaining a control method of the fixing apparatus according to the embodiment 3 of the present invention.

FIG. 10 is a flow chart for explaining a control method of the fixing apparatus according to the present embodiment. It should be noted that, in this control method, the ceramic heater is driven by feedback control based on the result detected by such a fixing film temperature detecting means.

In the present embodiment, the temperature of the fixing film is controlled to become 180° C.

In the control according to the present embodiment, in a case where the detected temperature of the fixing film is 170° C. or lower at the start of printing, when the temperature of the ceramic heater exceeds 225° C., the electrification to the ceramic heater is turned off. Then, when the detected temperature of the ceramic heater becomes lower than 220° C., it is controlled to again turn on the electrification to the ceramic heater.

Figure 11:
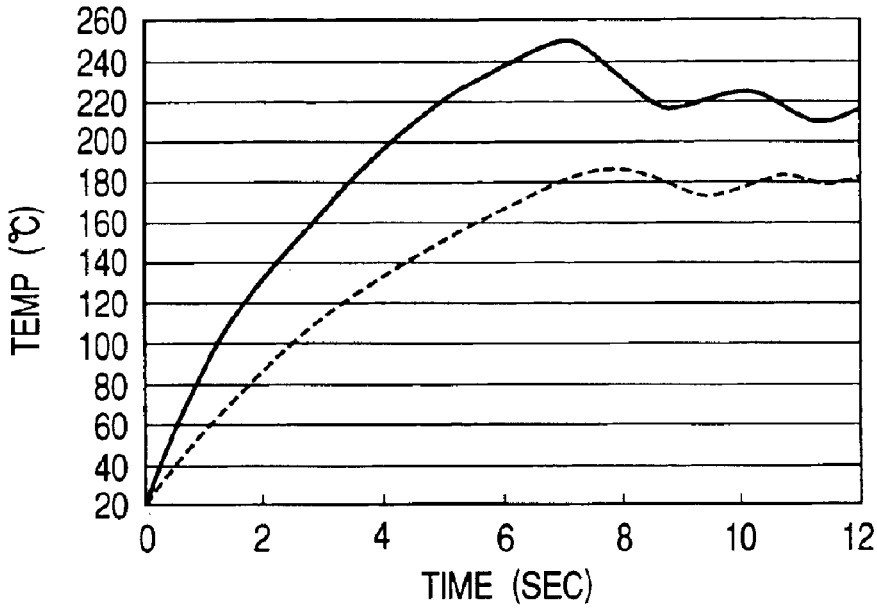
FIG. 11 is a graph for explaining a heat generating body temperature profile when a conventional fixing apparatus starts printing and a temperature profile on the surface of a fixing film.

A graph 5 in FIG. 11 is obtained by monitoring temperature rise curves on the rear surfaces of the ceramic heater and the fixing film at the start of printing in the conventional fixing apparatus. In FIG. 11, the solid line indicates the temperature of the ceramic heater, and the dotted line indicates the temperature of the fixing film.

According to FIG. 11, when the printing starts, both the temperature detected on the rear surface of the fixing film and the temperature detected on the ceramic heater rapidly increase, and the temperature of the ceramic heater maximally increases up to 250° C.

Figure 12:
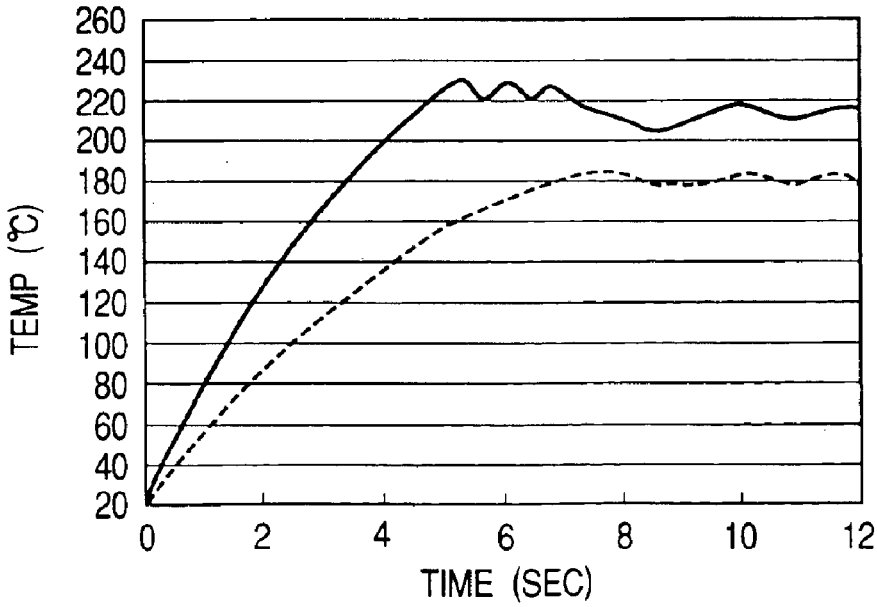
FIG. 12 is a graph for explaining a heat generating body temperature profile when printing is started and a temperature profile on the surface of a fixing film, according to the embodiment 3 of the present invention.

A graph 6 in FIG. 12 is obtained by monitoring temperature rise curves on the rear surfaces of the ceramic heater and the fixing film at the start of printing in the fixing apparatus according to the present embodiment. Also, in FIG. 12, the solid line indicates the temperature of the ceramic heater, and the dotted line indicates the temperature of the fixing film.

According to FIG. 12, although both the temperature detected on the rear surface of the fixing film and the temperature detected on the ceramic heater rapidly increase when the printing starts, the temperature of the ceramic heater is then controlled to 230° C. at the maximum because the electrification to the heater is turned off at a time when the temperature thereof exceeds 225° C.

The temperature of the fixing film does not rapidly drops even where the electrification to the ceramic heater is turned off, that is, it reaches a target temperature 180° C. within 12 seconds.

Figure 13:
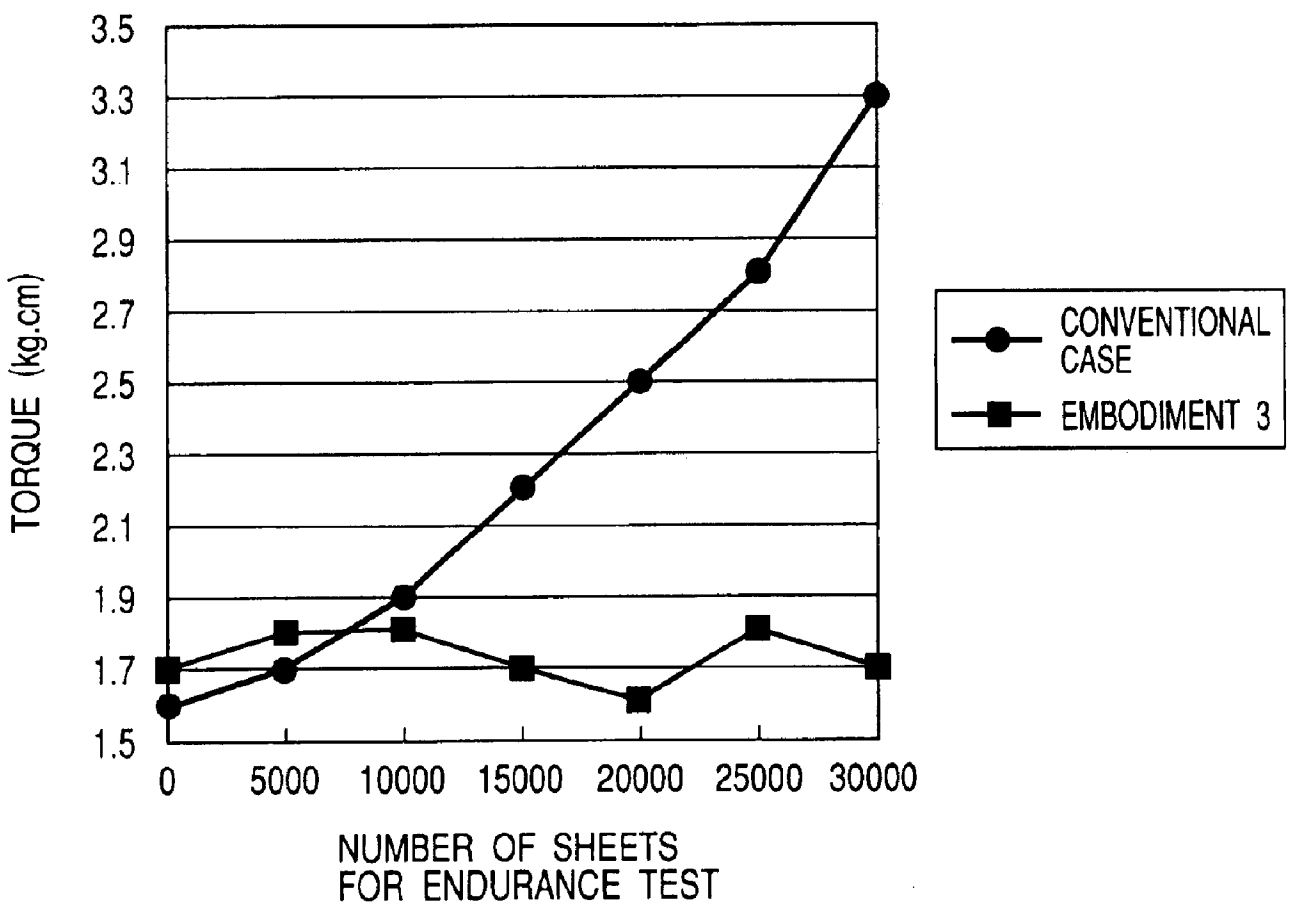
FIG. 13 is a graph for explaining a torque change of the fixing apparatus according to the embodiment 3 of the present invention.

A graph 7 in FIG. 13 shows rise speed of fixing apparatus torque in a case where images are output respectively by the conventional fixing apparatus and the fixing apparatus according to the present embodiment and then endurance tests are performed respectively for these apparatuses.

According to FIG. 13, the torque in the conventional fixing apparatus rises up to about twice after the recording materials of about 10,000 to 20,000 sheets passed. However, the torque hardly rises in the fixing apparatus according to the present embodiment. This is because, since the temperature of the ceramic heater is controlled to 230° C. or lower, the degree of deterioration of grease applied on the surface of the ceramic heater is small as compared with that in the conventional fixing apparatus, and also the torque rise speed is low.

(Embodiment 4)

The embodiment 4 of the present invention will be explained hereinafter. A fixing apparatus to be used in the present embodiment is the same as that used in the embodiment 1, whereby the explanation thereof will be omitted.

Figure 14:
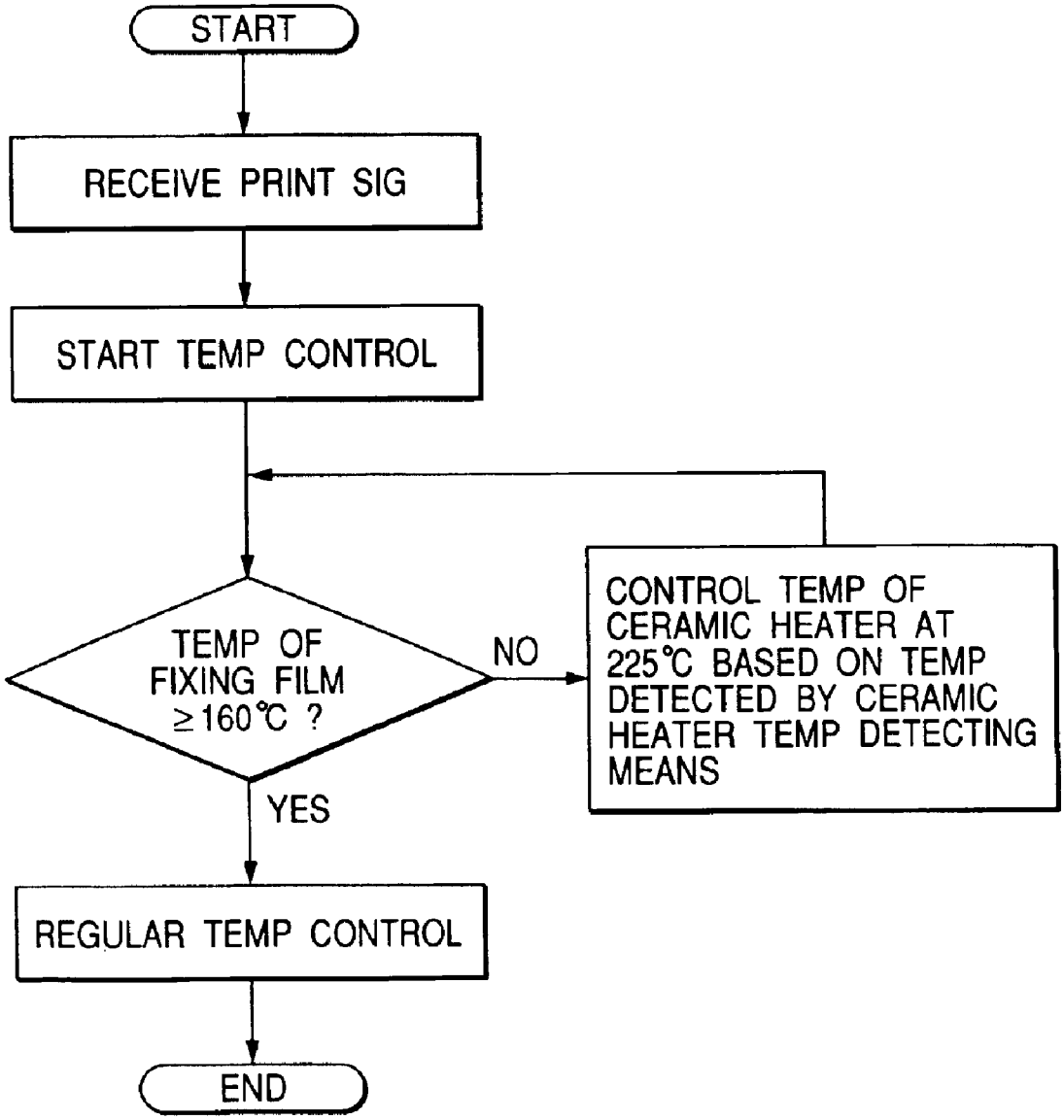
FIG. 14 is a flow chart for explaining a control method of the fixing apparatus according to the embodiment 4 of the present invention.

FIG. 14 is a flow chart for explaining a control method of the fixing apparatus according to the present embodiment. In the present embodiment, after printing started, a ceramic heater is controlled based on a temperature detected by a ceramic heater temperature detecting means until a temperature detected by a fixing film temperature detecting means exceeds 160° C. At this time, the temperature of the ceramic heater is controlled to 225° C. or lower.

In a case where the temperature detected by the fixing film temperature detecting means exceeds 160° C., the control of the ceramic heater is changed to ordinary control based on the temperature of the fixing film.

Also in the present embodiment, as well as the fixing apparatus according to the embodiment 3, the temperature of the ceramic heater does not exceed 230° C., and a torque hardly rises throughout an endurance test.

What is claimed is:

1. A fixing apparatus including a fixing film having an elastic layer, and a heat generating element provided so as to affect a non-fixing surface of said fixing film, said apparatus comprising:

a first temperature detecting element for detecting a temperature of said fixing film;

a second temperature detecting element for detecting a temperature of said heat generating element; and a controlling unit for controlling said heat generating element on the basis of the detection temperature of said fixing film detected by said first temperature detecting element, wherein said controlling unit temporarily controls said heat generating element on the basis of the detection temperature detected by said second temperature detecting element, when printing starts.

2. A fixing apparatus according to claim 1, wherein said heat generating element includes a ceramic substrate and a resistance heat generating body provided on said ceramic substrate.

3. A fixing apparatus according to claim 1, wherein said controlling unit temporarily controls said heat generating element on the basis of the detection temperature detected by said first temperature detecting element and the detection temperature detected by said second temperature detecting element, when printing starts.

4. A fixing apparatus according to claim 3, wherein said heat generating element includes a ceramic substrate and a resistance heat generating body provided on said ceramic substrate.

5. An image forming apparatus including image forming means for forming an unfixed image on an image transfer member to which an image should be transferred and a fixing device for fixing the unfixed image to said image transfer member, comprising:

a fixing film having an elastic layer;

a heat generating element provided so as to affect a non-fixing surface of said fixing film;

a first temperature detecting element for detecting a temperature of said fixing film;

a second temperature detecting element for detecting a temperature of said heat generating element; and a controlling unit for controlling said heat generating element on the basis of the detection temperature detected by said first temperature detecting element, wherein said controlling unit temporarily controls said heat generating element on the basis of the detection temperature detected by said second temperature detecting element, when printing starts.

6. An image forming apparatus according to claim 5, wherein said heat generating element includes a ceramic substrate and a resistance heat generating body provided on said ceramic substrate.

7. An image forming apparatus according to claim 5, wherein said controlling unit temporarily controls said heat generating element on the basis of the detection temperature detected by said first temperature detecting element and the detection temperature detected by said second temperature detecting element, when printing starts.

8. An image forming apparatus according to claim 7, wherein said heat generating element includes a ceramic substrate and a resistance heat generating body provided on said ceramic substrate.

9. A fixing apparatus including a fixing film having an elastic layer, and a heat generating element provided so as to affect a non-fixing surface of said fixing film, said apparatus comprising:

a first temperature detecting element for detecting a temperature of said fixing film;

a second temperature detecting element for detecting a temperature of said heat generating element; and a controlling unit for controlling said heat generating element, wherein said controlling unit has an operation mode in which said controlling unit controls said heat generating element so as not to raise the detection temperature of said second temperature detecting element and is capable of performing the operation mode during a warm-up operation in which said controlling unit controls said heat generating element so as to raise the detection temperature detected by said first temperature detecting element to a fixing temperature.

10. A fixing apparatus according to claim 9, wherein said controlling unit discriminates whether the operation mode is performed during the warm-up operation, in accordance with the detection temperature detected by said first temperature detecting element at a timing before the warm-up operation.

11. A fixing apparatus according to claim 9, wherein in the operation mode, said controlling unit controls said heat generating element such that the detection temperature detected by said second temperature detecting element become a predetermined temperature.

12. A fixing apparatus according to claim 9, wherein in the operation mode, said controlling unit turns off said heat generating element, when the detection temperature detected by said second temperature detecting element reaches a predetermined temperature.

13. A fixing apparatus according to claim 9, wherein said fixing apparatus starts a warm-up operation in response to a print instruction.

14. A fixing apparatus according to claim 9, wherein said fixing apparatus is used in a color image forming apparatus.

15. An image forming apparatus including image forming means for forming an unfixed image on an image transfer member to which an image should be transferred and a fixing device for fixing the unfixed image to said image transfer member, comprising:

a fixing film having an elastic layer;

a heat generating element provided so as to affect a non-fixing surface of said fixing film;

a first temperature detecting element for detecting a temperature of said fixing film;

a second temperature detecting element for detecting a temperature of said heat generating element; and a controlling unit for controlling said heat generating element, wherein said controlling unit has an operation mode in which said controlling unit controls said heat generating element so as not to raise the detection temperature of said second temperature detecting element and is capable of performing the operation mode during a warm-up operation in which said controlling unit controls said heat generating element so as to raise the detection temperature detected by said first temperature detecting element to a fixing temperature.

16. An image forming apparatus according to claim 15, wherein said controlling unit discriminates whether the operation mode is performed during the warm-up operation, in accordance with the detection temperature detected by said first temperature detecting element at a timing before the warm-up operation.

17. An image forming apparatus according to claim 15, wherein in the operation mode, said controlling unit controls said heat generating element such that the detection temperature detected by said second temperature detecting element become a predetermined temperature.

18. An image forming apparatus according to claim 15, wherein in the operation mode, said controlling unit turns off said heat generating element, when the detection temperature detected by said second temperature detecting element reaches a predetermined temperature.

19. An image forming apparatus according to claim 15, wherein said fixing apparatus starts a warm-up operation in response to a print instruction.

20. An image forming apparatus according to claim 15, wherein said image forming apparatus is a color image forming apparatus.

* * * * *

UNITED STATES PATENT AND TRADEMARK OFFICE

CERTIFICATE OF CORRECTION

PATENT NO. : 6,950,616 B2
DATED : September 27, 2005
INVENTOR(S) : Toru Saito et al.

It is certified that error appears in the above-identified patent and that said Letters Patent is hereby corrected as shown below:

Column 2,
Line 53, “enabling” should read -- enabling one --.

Column 3,
Line 37, “to” should read -- for --.

Column 6,
Lines 60 and 61, “he” should read -- the --.

Column 8,
Line 44, “EP” should read -- FEP --.

Column 9,
Line 14, “portion” should read -- portions --.

Column 14,
Line 36, “drops” should read -- drop --.
Line 37, “where” should read -- when --.
Line 61, “printing” should read -- printing is --.

Column 16,
Line 37, “become” should read -- becomes --.

Column 18,
Line 2, “become” should read -- becomes --.

Signed and Sealed this

Twenty-eighth Day of March, 2006

JON W. DUDAS
*Director of the United States Patent and Trademark Office*